US008701453B2

(12) United States Patent
Golovashchenko

(10) Patent No.: US 8,701,453 B2
(45) Date of Patent: Apr. 22, 2014

(54) METHOD OF REDUCING CYCLE TIME IN A HYDRO-MECHANICAL FORMING PROCESS AND A TOOL FOR HYDRO-MECHANICALLY FORMING A PART

(75) Inventor: Sergey Fedorovich Golovashchenko, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 653 days.

(21) Appl. No.: 12/977,650

(22) Filed: Dec. 23, 2010

(65) Prior Publication Data

US 2012/0160004 A1 Jun. 28, 2012

(51) Int. Cl.
*B21D 39/20* (2006.01)

(52) U.S. Cl.
USPC ..... 72/57; 72/54; 72/60; 72/453.14; 72/466.7

(58) Field of Classification Search
USPC ..... 72/54, 57, 60, 350, 370.22, 453.01, 72/453.14, 466.7; 29/421.1
See application file for complete search history.

(56) References Cited

U.S. PATENT DOCUMENTS

| | | | | | |
|---|---|---|---|---|---|
| 3,286,496 | A * | 11/1966 | Burk | ..... | 72/54 |
| 3,383,891 | A * | 5/1968 | Geitz | ..... | 72/57 |
| 4,229,965 | A * | 10/1980 | Spacek et al. | ..... | 72/453.13 |
| 4,472,955 | A * | 9/1984 | Nakamura et al. | ..... | 72/57 |
| 4,751,836 | A * | 6/1988 | Breese | ..... | 72/62 |
| 7,802,458 | B2 * | 9/2010 | Moller et al. | ..... | 72/57 |
| 2008/0202184 | A1 | 8/2008 | Moller et al. | | |

FOREIGN PATENT DOCUMENTS

| | | | |
|---|---|---|---|
| CN | 101244440 | A | 8/2008 |
| EP | 1188495 | A1 | 3/2002 |
| EP | 1197273 | A1 | 4/2002 |
| JP | 2007061829 | A | 3/2007 |

OTHER PUBLICATIONS

FMA, the fabricator.com, Sheet hydroforming in automotive applications—Press Technology Tech Cell—The Fabricator.com, http://www.fabricator.com/article/presstechnology/sheet-hydroforming-in-automotive-applications; Dec. 23, 2010.

Kasuga Y., Nozaki N., Kondo K., Pressure lubricated deep drawing Hydromechanical drawing. Bulletin of Japan Society of Mechanical Engineers 1961: 4:394-405.

http://www.aminonac.ca/product_ap.asp, Apr. 20, 2006.

* cited by examiner

*Primary Examiner* — Edward Tolan

(74) *Attorney, Agent, or Firm* — Raymond L. Coppiellie; Brooks Kushman P.C.

(57) ABSTRACT

A hydro-forming tool for use in a method of forming a blank into a liquid filled chamber. The chamber is formed by a container ring and a moveable wall that together define a variable volume chamber for containing the liquid. The wall is moveable relative to the container ring to provide a chamber in which the volume of liquid required to back up the blank is minimized. The liquid reduces friction at the chamber entry rim. Liquid may be ported through a counter punch to hydro-form the blank into the detail forming areas.

10 Claims, 2 Drawing Sheets

METHOD OF REDUCING CYCLE TIME IN A HYDRO-MECHANICAL FORMING PROCESS AND A TOOL FOR HYDRO-MECHANICALLY FORMING A PART

STATEMENT REGARDING FEDERALLY SPONSORED RESEARCH OR DEVELOPMENT

The invention was made with Government support under Contract No. DE-FG36-08G018128. The Government has certain rights to the invention.

BACKGROUND

1. Technical Field

This disclosure relates to hydro-mechanical forming tool having a chamber that is filled with a liquid during a method of reducing the cycle time for a hydro-mechanical forming operation.

2. Background Art

In one type of hydro-mechanical drawing process, a sheet metal blank is formed by drawing the blank onto a punch with the area below the blank being filled with a liquid. The liquid is compressed and forms the blank against the punch. The liquid eliminates the need for one side of the tooling.

The required pressure to completely form a production part is dictated by the tightest local radius of the part to be formed. A large press is required to apply maximum pressure to the entire surface of the blank that is required to form relatively small tight local radii.

Hybrid hydro-mechanical drawing followed by conventional forming in two-sided dies is a known process being conducted in a single tool, in which the blank is initially formed by hydro-mechanical drawing. Then, local features that may have tight local radii are formed subsequently in a two-sided die. Hybrid hydro-mechanical drawing enables deeper drawing of the blank compared to forming on a conventional press. However, the maximum elongation of the blank usually remains within the forming limit diagram of the material being formed.

One problem with hydro-mechanical drawing is that a relatively long cycle time is required, which can approach one minute for forming large automotive panels. The long cycle time is required because a substantial volume of water (several hundreds of liters) must be delivered to the tool and drained from the tool within each forming cycle.

Substantial energy and time is required to generate sufficient pressure for forming operations. Specialized equipment, including a several thousand ton hydraulic tool, may be required to implement the hydro-mechanical drawing process. The size of the press can be significantly reduced, and pre-existing press equipment in manufacturing plants can be used if the volume of liquid required to form a part is substantially reduced. There is a need for a process and tooling that focuses the hydro-mechanical force in limited areas where the application of pressure applied by the liquid is most beneficial.

The above problems are addressed by applicant's developments as summarized below.

SUMMARY

According to one aspect of this disclosure, a hydro-mechanical tool for forming a metal blank is provided that includes a punch having a die forming surface, a blank holder ring that engages a first side of the blank, and a liquid chamber. The liquid chamber includes a liquid container ring that engages a second side of the blank and a counter punch in the form of a movable wall, or floor, that forms the liquid chamber in combination with the container ring. A volume of liquid is contained within the liquid container ring and on the counter punch. When the forming surface engages the blank while the blank is retained between the blank holder ring and the liquid container ring, the liquid forms the blank to the forming surface.

According to another aspect of the disclosure as it relates to the hydro-mechanical tool, the container ring may include a die entry radius. A portion of the liquid is supplied through the container ring to the die entry radius to reduce friction between the blank and the die entry radius of the container ring.

According to another aspect of the disclosure as it relates to the hydro-mechanical tool, an actuator may be provided that moves the wall toward and away from the blank.

According to another aspect of the disclosure as it relates to the hydro-mechanical tool, the wall of the hydro-mechanical tool may engage the second side of the blank without any liquid being provided between the wall and the blank. Liquid may be provided between the container ring and the blank outboard of the punch, as the blank is formed into the container ring. The liquid flows underneath the flange of the blank, as it is drawn, and lifts the area where the blank enters the die cavity. The liquid under the flange eliminates or reduces friction at the entry into the die cavity.

According to another aspect of the disclosure, the hydro-mechanical tool may have a space provided between the container ring and a side portion of the wall that extends from a die entry radius of the container ring to a seal point between the container ring and a side portion of the wall. The liquid flows underneath the flange of the blank as it is drawn and lifts the area where the blank enters the die cavity. The liquid under the flange reduces friction at the entry into the die cavity.

According to another aspect of the disclosure as it relates to the hydro-mechanical tool, the wall of the hydro-mechanical forming press may define at least one port that is in fluid flow communication with a source of pressurized liquid and opens into a surface on the wall that faces the blank. The hydro-forming pressure is applied to the blank in localized areas where the port opens into the surface of the wall to form the blank into a detail area of the forming surface.

According to another aspect of the disclosure, the hydro-mechanical tool may further comprise a face seal provided on the surface of the wall that faces the blank to form a seal with the blank to limit the area within which the hydro-forming pressure is applied.

According to another aspect of the disclosure, the hydro-mechanical tool may further comprise at least one recessed area formed in the forming surface of the punch into which a portion of the blank is drawn by the action of the punch. A protrusion may be provided on the surface on the wall that faces the blank within the seal that extends towards the recessed area in the forming surface of the punch. The protrusion is provided to reduce the volume of liquid required to form the blank in the detail area of the forming surface.

According to another aspect of the disclosure, the hydro-mechanical tool may define a cavity in the surface of the wall that faces the blank. The wall defines a hydro-forming chamber with the blank and limits the area within which hydro-forming pressure is applied.

According to another aspect of the disclosure, a process for reducing the cycle time of a hydro-mechanical forming operation is disclosed in which a liquid filler forming chamber has a variable volume. The volume of liquid is minimized to reduce the time required to drain and fill the chamber. Also, by reducing the volume of liquid, less force is required to form a part.

According to another aspect of the disclosure, a method of forming a metal blank in a hydro-mechanical tool is provided. The tool has a punch with a die forming surface and a blank holder ring on one side of the blank. A container ring cooperates with a movable wall that moves relative to the container ring to define a chamber on the other side of the blank. The method of forming the blank includes the step of loading a blank onto the container ring. The blank is clamped with the blank holder ring against the container ring. The chamber is filled with a volume of liquid up to the level of the blank. The blank is drawn into the chamber with the punch against the resistance of the liquid in the chamber. The die forming surface engages the blank while the blank is retained between the blank holder ring and the container ring. The wall engages the second side of the blank with liquid being provided between the container ring and the blank outboard of the punch as the blank is formed into the container ring.

According to other aspects of the method, the hydro-mechanical tool may include an actuator that moves a counter punch in tandem with the punch through at least a part of the drawing step.

Other aspects of the method relate to providing a counter punch that defines at least one liquid supply channel that is ported to a hydroforming chamber that is disposed on the opposite side of the blank from a detail forming area on the punch. The method may further comprise supplying the liquid under pressure to the hydroforming chamber to form the blank into the detail forming area.

The hydro-mechanical tool may include an actuator that is used to move the counter punch toward and away from the blank. The hydro-mechanical tool may also include a counter punch and container ring that define a space between the blank and the counter punch. If so, the method may further comprise supplying the liquid to the space to reduce friction between the blank and the container ring. The method may also relate to the concept of providing a tool with a die entry radius which according to the method may further comprise supplying a portion of the liquid through the container ring to the die entry radius to reduce friction between the blank and the die entry radius of the container ring.

The above advantages and other features of the disclosure will be more fully understood in view of the attached drawings and the following detailed description of the illustrated embodiments.

DETAILED DESCRIPTION

Figure 1:
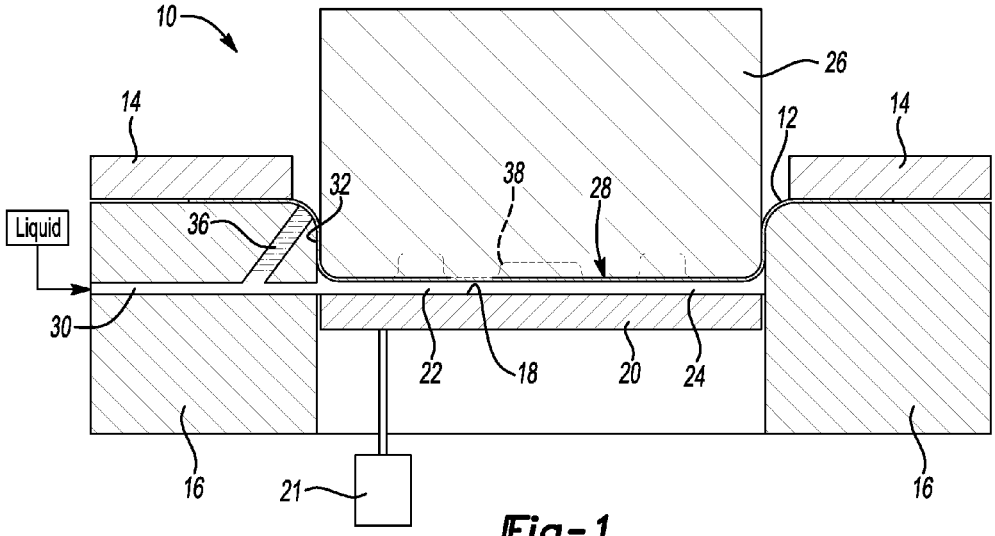
FIG. 1 is a diagrammatic cross-sectional view of a hydro-mechanical forming tool that has a moveable bottom wall that is provided on a counter punch that supports a volume of liquid and a channel that provides liquid to the die entry radius.

Several different embodiments of Applicant's development are disclosed and described in detail below. For brevity, similar parts of the various embodiments are referred to by the same name and reference numeral in the various embodiments.

Referring to FIG. 1, a hydro-forming tool 10 is used to form a sheet metal blank 12. The blank 12 is held by a blank holder ring 14 to a container ring 16. The wall 18, as shown in FIG. 1, is the top surface of a counter punch 20. The counter punch 20 is moved relative to the container ring 16 by a hydraulic cylinder 21, or another actuator such as a pneumatic cylinder, press ram or other mechanical linkage. The container 16 and moveable wall 18 together define a chamber in which a process fluid, such as water, is supplied.

A punch 26 is retained in a hydraulic or mechanical press that moves the punch 26 reciprocally relative to the counter punch 20. The blank 12 is formed against a punch forming surface 28 of the punch 26. The liquid 22 provides a reaction surface that forms the blank 12 against the forming surface 28.

A primary liquid supply channel 30 is used to supply and drain the liquid 22 from the space 24 defined by the container ring 16 and the wall 18. The wall 18 moves in tandem with the ram 26 as the ram 26 is lowered. A primary advantage of the wall 18 being movable is that a reduced volume of liquid 22 is required for the forming process. As the wall 18 is raised within the container ring 16, a reduced volume 18 of liquid is contained in the chamber. The reduced volume of liquid reduces the cycle time because less water must be pumped into and drained out of the chamber.

The container ring 16 has a chamber entry rim 32 across which the blank 12 is drawn, as the punch 26 draws the blank 12 against the forming surface 28. A chamber entry fluid channel 36 provides liquid 22 from the primary liquid supply channel 30 to the chamber entry rim 32. The fluid 22 provides that the chamber entry rim 32 reduces friction as the blank 12 is drawn into the container ring 16.

Several detail forming areas 38 are provided on the forming surface 28. The blank 12 is formed into the forming areas 38 by the fluid pressure provided by the liquid 22 in the chamber.

Figure 2:
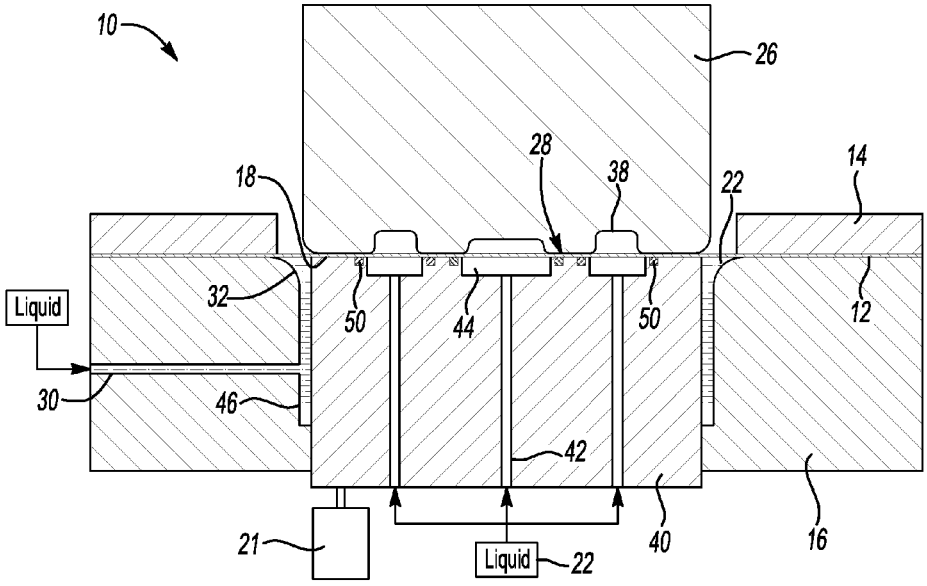
FIG. 2 is a diagrammatic cross-sectional view of a hydro-mechanical forming tool that includes a moveable wall that is provided on a counter punch about which a small gap is provided for receiving liquid that also supplies liquid to the die entry radius.
Figure 3:
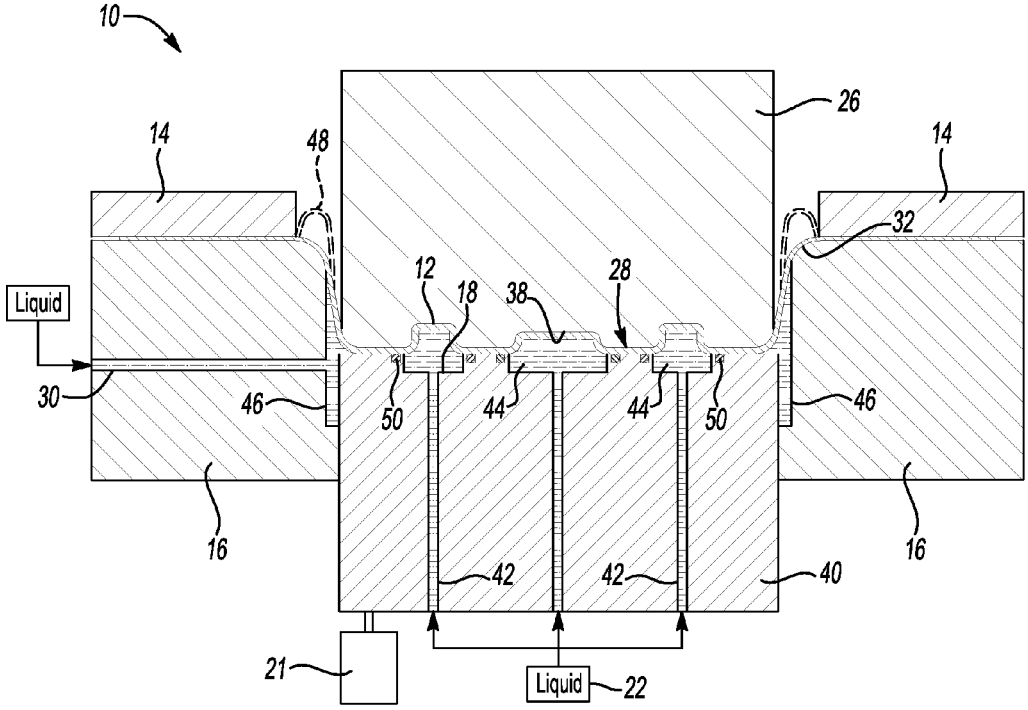
FIG. 3 is a diagrammatic cross-sectional view of a hydro-mechanical forming tool with the forming ram engaging the blank while the blank is supported by the counter punch.

Referring to FIGS. 2 and 3, an alternative embodiment is shown at two different points in the process. A hydro-forming tool 10 is shown for forming a blank 12. Many of the components of the hydro-forming tool 10 are the same as were described with reference to FIG. 1. The blank holder ring 14 holds the blank 12 against the container ring 16. A moveable wall 18 is formed as part of the counter punch 40 that differs from the counter punch 22 of FIG. 1 in that it includes a plurality of hydro-forming liquid supply channels 42. The liquid supply channels 42 provide liquid to partial hydro-forming chambers 44 that are located on the opposite side of the blank 12 from detail forming areas 38. Fluid is supplied to the hydro-forming liquid supply channels 42 under pressure to form the blank 12 into the detail forming areas 38. Fluid is also supplied through the primary liquid supply channel 30 to a counter punch fluid jacket 46 that extends about the counter punch 40. The fluid in the counter punch fluid jacket 46 reduces friction as the blank 12 is drawn across the chamber entry rim 32.

Referring to FIG. 3, a material flow pocket 48 is shown in phantom lines that show the pocket 48, as the blank 12 is formed in solid lines that show the shape of the blank after forming. The material flow pocket 48, as shown, may be somewhat exaggerated, but it should be understood that the material flow pocket 48 is created by liquid pressure below the blank 12 as the blank 12 is drawn into the hydro-forming tool 10.

Referring specifically to FIG. 2, the blank 12 is shown retained between the blank holder ring 14 and the container ring 16. The moveable wall 18 is shown supporting the lower surface of the blank 12 at the point in the cycle where the punch 26 initially engages the top side of the blank 12. The liquid 22 is supplied through the primary liquid supply channel 30 to the counter punch fluid jacket 46. The liquid reduces friction at the chamber entry rim 32.

Referring to FIG. 3, the hydro-forming tool 10 is shown with the punch 26 fully advanced with the blank 12 being shown in its fully drawn condition. The moveable wall 18 of the counter punch 40 is in engagement with the blank 12. Movement of the counter punch 40 reduces the volume of liquid 22 which also reduces the amount of time necessary to fill and drain the chamber formed by the container ring 16 and the moveable wall 18. At this point, the blank 12 is nearly fully formed and a final forming process may be performed by introducing a pressurized liquid 22 through the hydro-forming liquid supply channels 42. The fluid introduced through the supply channels 42 is provided to the partial hydro-forming chambers 44 below the blank 12. When the pressurized fluid is introduced into the partial hydro-forming chambers 44, the blank 12 is formed into the detail forming areas 38 of the forming surface 28. Seals 50 are provided around the forming chambers 44 that seal against the bottom of the blank 12.

The reduced size of the partial hydro-forming chambers 44 reduces the volume of liquid required to form the blank in the detail forming areas 38. The detail forming areas 38 have less surface area then the entire forming surface 28. The reduced volume of liquid reduces the force required to form the blank as compared to the force required to form the blank over the entire forming surface 28.

A hydraulic cylinder 21 or other mechanical actuator is connected to the counter punch 40 to move the counter punch 40 and the wall 18 relative to the container ring 16. When the hydro-forming liquid supply channel 42 is filled, no fluid is disposed between the blank 12 and the wall 18. By reducing the amount of liquid applying pressure to the surface of the blank, less force is required to form parts of the blank 12 into the detail forming areas 38.

Figure 4:
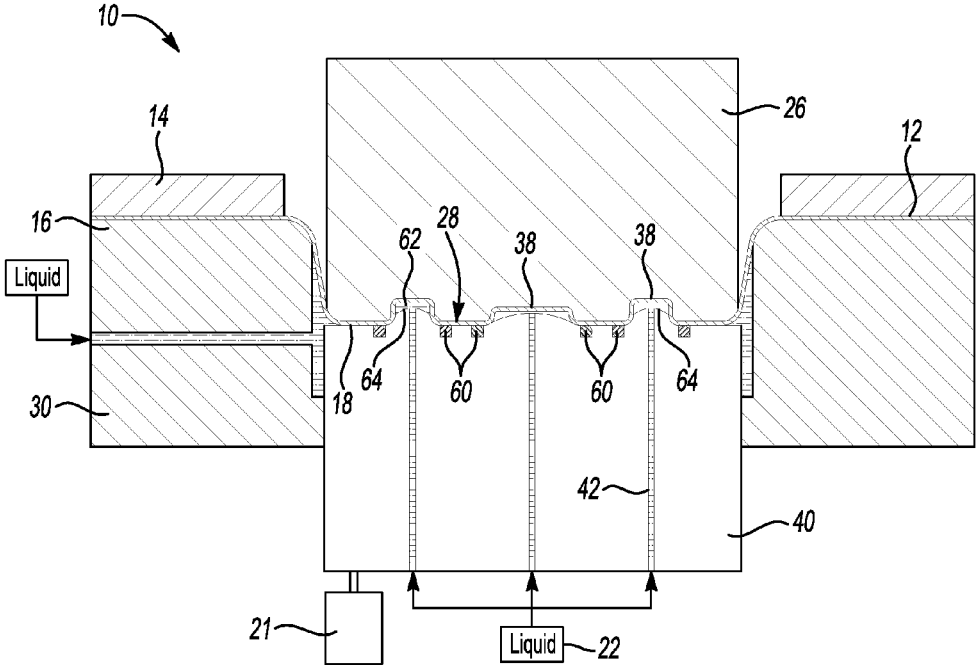
FIG. 4 is a diagrammatic cross-sectional view of a hydro-mechanical forming tool with hydro-mechanical forming fluid being provided in small volumes at the bottom of the die cavity.

Referring to FIG. 4, another embodiment of the hydro-forming tool 10 is shown that includes a counter punch 40 with EHF liquid channels 42 that provide liquid 22 under pressure to a plurality of mini-hydro-forming chambers 62 on the forming surface 28 of the punch 26. The mini-hydro-forming chambers 62 are further reduced in volume by providing protrusions 64 on the moveable wall 18 that are received within the mini-hydro-forming chambers 62. The protrusions 64 may be used to start mechanically forming the panel 12 into detail forming areas 38. Liquid supplied through the hydro-forming liquid supply channel 42 fills the mini-hydro-forming chambers 62. A plurality of seals forms a seal between the blank 12 and the wall 18 at the outer periphery of the mini-hydro-forming chambers 62.

The entire forming process used to form the panel, as shown in FIG. 4, follows the general steps of the process described with reference to FIGS. 2 and 3 to the point that the blank 12 is fully formed by the punch 26 with the blank 12 being formed against the wall 18. At this point, fluid is introduced through the hydro-forming liquid channel 42 that fills the mini-hydro-forming chamber 62. Part of the volume of the space below the blank 12 in the mini-hydro-forming chamber 62 is filled by the space occupied by the protrusion 64. In this way, the amount of liquid in the mini-hydro-forming chamber 62 is further reduced, which also reduces the volume of liquid and the amount of force required to form the blank into the detail forming areas 38.

Although several embodiments of the invention have been disclosed, it will be apparent to persons skilled in the art that modifications may be made without departing from the scope of the invention. All such modifications and improvements therein are covered by the following claims.

What is claimed:

1. A hydro-mechanical tool for forming a metal blank, comprising:

a punch having a die forming surface;

a blank holder ring that engages a first side of the blank;

a container ring engages a second side of the blank, and cooperates with a movable wall that moves relative to the container ring to define a chamber that has a variable volume;

at least one recessed area formed in the forming surface of the punch into which a portion of the blank is drawn by the action of the punch, and a protrusion provided on the surface of the punch to reduce the volume of liquid required to form the blank into a detail area of the forming surface; and a volume of liquid contained within the liquid container ring and on the wall, wherein the forming surface engages the blank while the blank is retained between the blank holder ring and the liquid container ring, and the liquid causes the blank to conform to the forming surface when the punch is driven into the blank wherein the wall defines at least one port that is in fluid flow communication with a source of pressurized liquid and opens into a surface on the wall that faces the blank, wherein hydro-mechanical forming pressure is applied to the blank in localized areas where the port opens into the surface of the wall to form the blank into a detail area of the forming surface.

2. The hydro-mechanical tool of claim 1 wherein the container ring includes a die entry radius and a portion of the liquid is supplied through the container ring to the die entry radius to reduce friction between the blank and the die entry radius of the container ring.

3. The hydro-mechanical tool of claim 1 further comprises an actuator that moves the wall toward and away from the blank.

4. A hydro-mechanical tool for forming a metal blank, comprising:

a punch having a die forming surface;

a blank holder ring that engages a first side of the blank;

a container ring engages a second side of the blank, and cooperates with a movable wall that moves relative to the container ring to define a chamber;

a face seal provided on the surface on the wall that faces the blank that forms a seal with the blank to limit the area within which the hydro-forming pressure is applied;

at least one recessed area formed in the forming surface of the punch into which a portion of the blank is drawn by the action of the punch, and a protrusion provided on the surface on the wall that faces the blank within the seal and that extends towards the recessed area in the forming surface of the punch to reduce the volume of liquid required to form the blank into a detail area of the forming surface; and a volume of liquid contained within the chamber, wherein the forming surface engages the blank while the blank is retained between the blank holder ring and the container ring, wherein the wall engages the second side of the blank without liquid between the wall and the blank but with liquid being provided between the container ring and the blank outboard of the punch, as the blank is formed into the container ring, blank wherein the wall defines at least one port that is in fluid flow communication with a source of pressurized liquid and opens into a surface on the wall that faces the blank, wherein hydro-mechanical forming pressure is applied to the blank in localized areas where the port opens into the surface of the wall to form the blank into a detail area of the forming surface.

5. The hydro-mechanical tool of claim 4 wherein a space is provided between the container ring and a side portion of the wall that extends from a die entry radius of the container ring to a seal point between the container ring and a side portion of the wall.

6. A method of forming a metal blank in a hydro-mechanical tool that has a punch having a die forming surface, a blank holder ring, and a container ring that cooperates with a movable wall that moves relative to the container ring to define a chamber, a counter punch that defines at least one liquid supply channel that is ported to a hydroforming chamber and a protrusion provided on the surface on the wall that faces the blank and that extends toward the recessed area in the forming surface of the punch, the hydroforming chamber is disposed on the opposite side of the blank from a detail forming area on the punch, the method comprising:

loading a blank onto the container ring;

clamping the blank with the blank holder ring against the container ring;

filling the chamber with a volume of liquid up to the level of the blank;

drawing the blank into the chamber with the punch against the resistance of the liquid in the chamber, wherein the die forming surface engages the blank while the blank is retained between the blank holder ring and the container ring, and wherein the wall engages the second side of the blank with liquid being provided between the container ring and the blank outboard of the punch while the blank is formed into the container ring, and further comprising supplying the liquid under pressure to the hydroforming chamber to form the blank into the detail forming area, and wherein the protrusion reduces the volume of liquid required to form the blank into a detail area of the forming surface.

7. The method of claim 6 wherein the hydro-mechanical tool includes an actuator, the method further comprising moving a counter punch in tandem with the punch through at least a part of the drawing step.

8. The method of claim 6 wherein the hydro-mechanical tool includes an actuator and a counter punch, wherein the method further comprises moving the counter punch with the actuator toward and away from the blank.

9. The method of claim 6 wherein the hydro-mechanical tool includes a counter punch, and the container ring defines a space between the blank and the counter punch, the method further comprising supplying the liquid to the space to reduce friction between the blank and the container ring.

10. The method of claim 6 wherein the hydro-mechanical tool includes a die entry radius, the method further comprising supplying a portion of the liquid through the container ring to the die entry radius to reduce friction between the blank and the die entry radius of the container ring.

* * * * *